United States Patent [19]

Battle

[11] Patent Number: 4,635,552

[45] Date of Patent: Jan. 13, 1987

[54] UNIQUE SIGNAL, SAFE AND ARM DEVICE

[75] Inventor: Stanley D. Battle, San Diego, Calif.

[73] Assignee: The United States of America as represented by the Secretary of the Air Force, Washington, D.C.

[21] Appl. No.: 765,764

[22] Filed: Aug. 15, 1985

[51] Int. Cl.[4] ..... F42C 15/40; F42C 15/34; F42C 19/00; F42C 15/06

[52] U.S. Cl. ..... 102/254; 102/201; 102/222; 102/262

[58] Field of Search ..... 102/254, 262, 222, 221, 102/201

[56] References Cited

U.S. PATENT DOCUMENTS

| | | | |
|---|---|---|---|
| 3,306,207 | 2/1967 | Becker et al. | 102/254 |
| 3,688,636 | 9/1972 | Spless et al. | 89/1.8 |
| 4,047,483 | 9/1977 | Williams | 102/201 X |
| 4,240,351 | 12/1980 | San Miguel | 102/254 X |
| 4,278,026 | 7/1981 | Hibbs et al. | 102/254 |
| 4,346,658 | 8/1982 | Hibbs et al. | 102/254 |
| 4,391,195 | 7/1983 | Shann | 102/201 |
| 4,470,351 | 9/1984 | Farace | 102/262 X |
| 4,489,656 | 12/1984 | Hennings et al. | 102/254 |

OTHER PUBLICATIONS

Working Paper, "Approaches for Achieving Nuclear Weapon Electrical System Safety in Abnormal Environment (U)", SC-DR-72-0492, Aug. 1972.

*Primary Examiner*—David H. Brown

*Attorney, Agent, or Firm*—Jacob N. Erlich; Donald J. Singer

[57] ABSTRACT

A unique signal, safe and arming device for preventing the inadvertent detonation of an ordnance, having an initiator barrier disk and an ignitor barrier disk situated adjacent respective opposite open ends of at least one transfer tube containing an initiator therein. The barrier disks are interconnected to move in synchronism with each other from a first position blocking the ends of the transfer tube to a second position unblocking the ends of the transfer tube. A maze-like slot is located within the ignitor barrier disk and a peg operably engages the maze-like slot. While the ignitor barrier disk moves from its first position to its second position under the control of preselected signals, the peg moves radially within the slot also under the control of preselected signals. This arrangement requires the proper input signals for the appropriate movement of both the peg and ignitor barrier disk in order to permit activation of the initiator to take place. In addition, a monitoring system is included in order to constantly monitor the movement of the disks and the positioning of the peg.

24 Claims, 11 Drawing Figures

UNIQUE SIGNAL, SAFE AND ARM DEVICE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to safe and arm devices, and, more particularly, to a safe and arm device utilized in conjunction with ordnance or other systems which require extremely controllable ignition.

One of the most critical elements in an ordnance is the safe and arming mechanism utilized to maintain the ordnance in a safe condition until proper inputs are received and thereafter to initiate the arming sequence. Generally, receipt of proper input signals results in transforming the safe and arming mechanism from the safe condition into a condition in which a main explosive charge or ignitor can be detonated.

During its lifetime, an ordnance may be subjected to various physical environments which impose severe conditions thereupon. The parameters for many of these environments lead to the design criteria for manufacturing the ordnance. Recent weapon development guidance documents have included specifications for abnormal weapon conditions such as exposure to fire, crushing, severe shock, lightening, flooding, and fragments. One recognition to be gained from such documents is the degree of uncertainty associated with the environment and the difficulty in providing precise and accurate definitions for normal or accident situations. Consequently, there is a general trend toward a complex interrelationship among the major components of a weapon in order to negate accidental or unintentional detonation. Furthermore, it is critical that the detonating systems for such ordnance be isolated from all sources of electrical energy in order to avoid premature detonation.

Many current state of the art art safe and arming mechanisms rely upon either mechanical escapements or electronic timers to provide safe separation timing delays. Further, many mechanisms incorporate or rely upon stored energy for component movement or alignment power. Consequently, the above-mentioned safe and arming mechanisms generally fall short in reliability and predictability of operation as a result of the inflexibility of the mechanical systems and relatively poor timing accuracy involved therewith; the unreliability of mechanical-electrical interlocks as well as the susceptibility of the electrical energy to prematurely or accidentally detonate the ordnance; and the unsatisfactory condition of stored energy which can result in unwanted arming of the ordnance due to inadvertent release of the stored energy.

It is therefore essential that a safe and arm device be devised which not only provides a high degree of certainty in the initiation of an ignitor or detonating charge within an ordnance or the like, but which also is capable of withstanding the effects of abnormal environmental conditions.

SUMMARY OF THE INVENTION

The present invention overcomes the problems associated with past safe and arm mechanisms by providing a safe and arm device which relies upon a unique signal in the form of a maze-like path which must be followed during the arming sequence of the ordnance in order for detonation to take place. Furthermore, by the elimination of direct electrical energy inputs, inadvertent ignition or detonation by electrical sources is substantially eliminated. In addition, at any time during the arming procedure the exact state of the safe and arm device of this invention is monitored, with the present invention also having the capability of being returned to its initial safe state at any time during this arming procedure.

The safe and arm device of the present invention is packaged in a cylindrical housing which contains two compartments, an initiator compartment and a drive compartment. The initiator compartment includes therein at least one transfer tube in which a conventional initiator is positioned, and an ignitor barrier disk operably associated adjacent one end thereof. The drive compartment contains an initiator barrier disk positioned adjacent the other end of the transfer tube and a pair of stepper motors. One of the stepper motors is utilized to simultaneously drive the ignitor barrier disk and initiator barrier disk from the safe position to the armed position while the other stepper motor drives a peg operably associated with a unique maze-like configured path or slot formed within the ignitor barrier disk. The interrelationship between the peg and maze-like slot in the ignitor barrier disk controls the initiation of the initiator and subsequent detonation of an ignitor located within, for example, an ordnance or the like.

More specifically, the safe and arm device of the present invention is incorporated within an ordnance and in operable engagement within an ignitor. However, it should be realized that the safe and arm device of this invention is not limited to ordnances but may be used in conjunction with any type of system in which ignition or detonation thereof is to take place when certain preselected conditions are met. Once armed, actual activation of the initiator is provided either electrically or optically. It is the discharge from the initiator or initiators within the device which is relied upon to cause the ignitor to detonate.

In the present invention, during the safe condition the position of the initiator barrier disk prevents either electrical interconnection or optical interconnection of the initiator from occurring. Likewise, the position of the ignitor barrier disk prevents any gases from accidental actuation of the initiators from reaching the ignitor. Both the initiator barrier disk and ignitor barrier disk are interconnected to each other in order to enable the disks to simultaneously rotate from the safe position to an armed position in which initiation and subsequent detonation can take place.

In order to prevent any accidental or inadvertent rotation of the disks from the safe position to the armed position, the ignitor barrier disk of the present invention incorporates therein a uniquely designed maze-like cutout path or slot of preselected configuration. A peg mounted on a movable carriage is positioned with respect to the ignitor disk such that the peg passes through the maze-like cutout design within the ignitor barrier disk. Preselected signals fed into stepper motors located with the drive compartment and isolated from the initiator compartment activate the stepper motors such that the stepper motors rotate the ignitor barrier disk in a step-like sequence while also sequentially moving the peg within the maze-like slotted path, respectively. If appropriate movement takes place by the ignitor barrier disk and peg, the peg follows the maze-like slot from beginning to end such that the ignitor barrier disk and the initiator barrier disk connected thereto are no longer in a safe or blocking position with respect to the initiator located within the transfer tube. If, on the other hand, improper signals are given to the stepper motors, the peg jams within the maze-like slot in the ignitor barrier disk and arming of the device cannot take place. Once the ignitor barrier disk and initiator barrier disks are appropriately disposed with respect to the transfer tubes, initiation and subsequent detonation of the ordnance can take place.

During the above-mentioned arming procedure, a monitoring system utilized in conjunction with the ignitor barrier disk enables the operator of the present invention to maintain a constant readout of the position of both the ignitor barrier disk, peg and carriage arrangement as well as the initiator disk. Furthermore, if at any time during the arming sequence it is necessary or desirable to disarm the ordnance and return the safe and arm device of this invention to its unarmed position, it is possible to remove the peg from the maze-like slot in the ignitor barrier disk and return both of the disks and the peg and carriage to their original safe position.

It is therefore an object of this invention to provide a safe and arm device which relies upon a unique signal for the arming thereof.

It is another object of this invention to provide a safe and arm device which incorporates as the unique signal a preselectively designed maze-like slot which must be followed at all times by a controllable peg.

It is still another object of this invention to provide a safe and arm device which is capable of being monitored at all times during the arming sequence.

It is a further object of this invention to provide a safe and arm device which is capable of being returned to its original safe, unarmed position at any time during the arming sequence.

It is still another object of this inventon to provide a safe and arm device which can be incorporated within either an ordnance or in any other device which requires preselected ignition.

It is even a further object of this invention to provide a safe and arm device which is economical to produce and which utilizes conventional, currently available components that lend themselves to standard mass producing manufacturing techniques.

For a better understanding of the present invention, together with other and further objects thereof, reference is now made to the following description taken in conjunction with the accompanying drawings and its scope will be pointed out in the appended claims.

DETAILED DESCRIPTION OF THE PREFERRED EMBODIMENT

Figure 1:
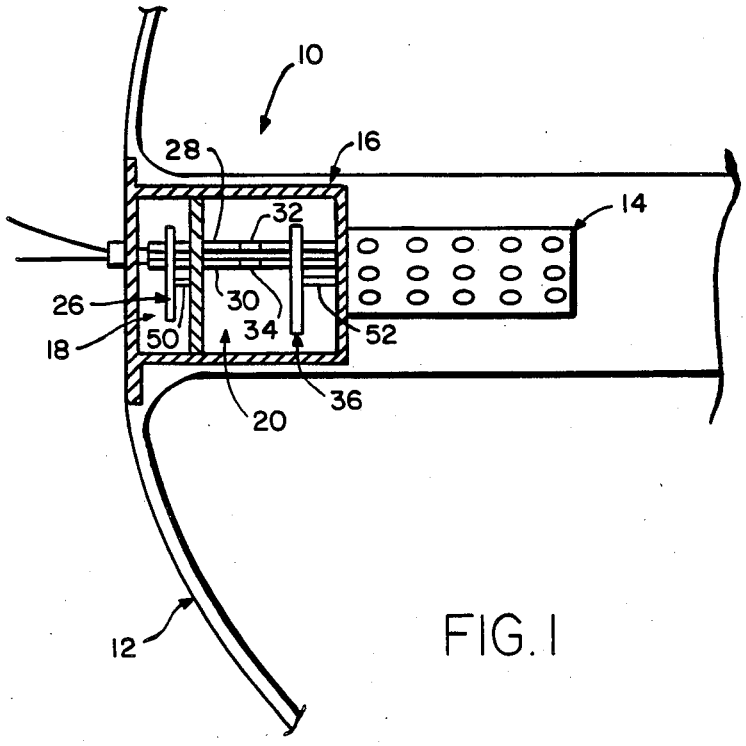
FIG. 1 is a side elevational view, shown partially in segmented fashion, of the unique signal, safe and arm device of the present invention and shown partly in cross section.

Reference is now made to FIG. 1 of the drawings which clearly illustrates the overall configuration of the unique signal, safe and arm device 10 of the present invention. As illustrated in FIG. 1, the safe and arm device 10 of this invention is mounted within any suitable ordnance 12 having a conventional ignitor 14 therein. Although the present invention is depicted as being in combination with an ordnance 12, it should be realized that the safe and arm device 10 of the present invention may just as readily be incorporated in any type device which relies upon pyrotechnic ignition and in which it is undesirable for the device to be accidentally actuated.

Figure 3:
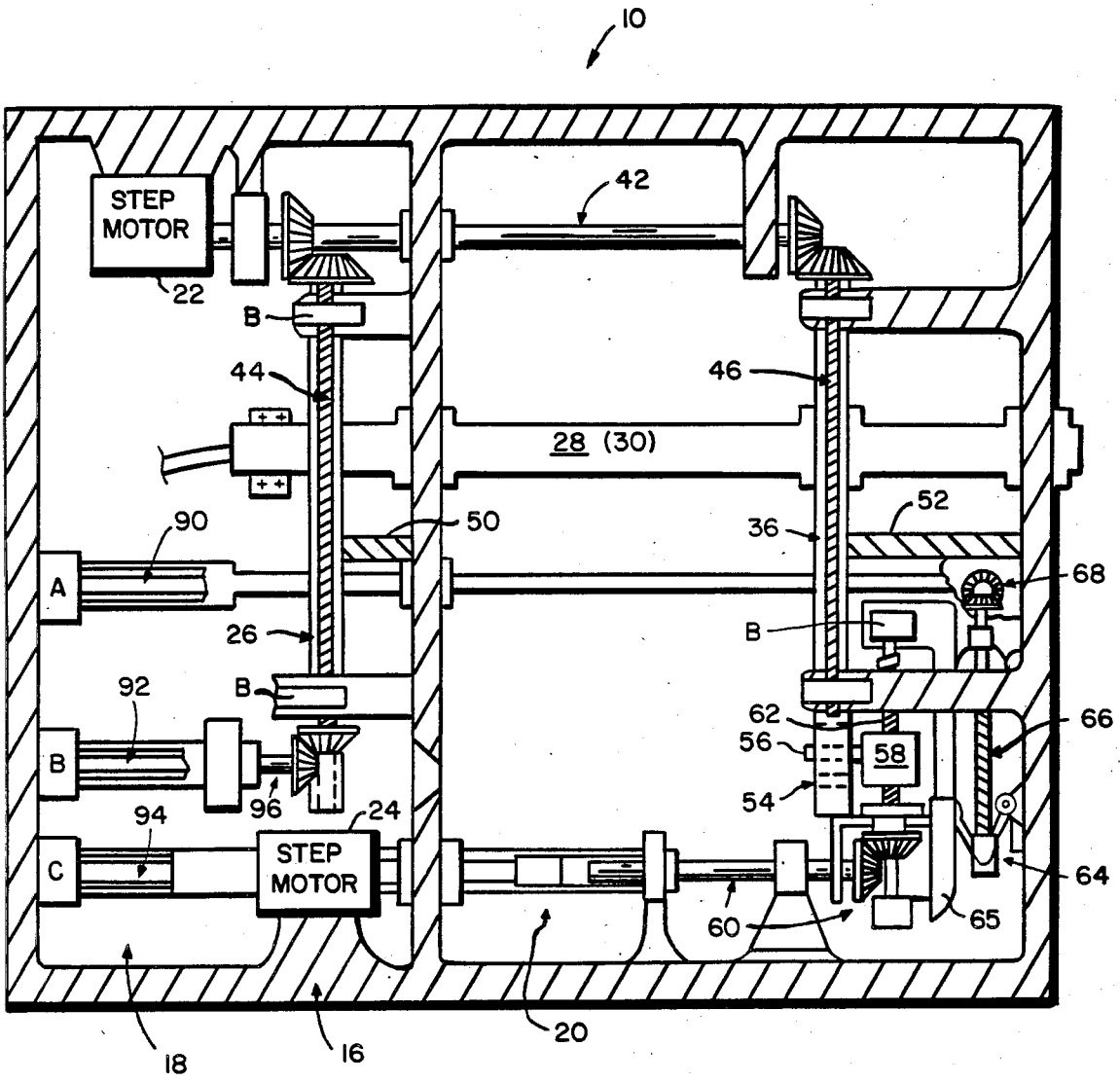
FIG. 3 is a top view of the safe and arm device of the present invention, shown partly in cross section.

Safe and arm device 10 is made up of a preferably cylindrically-shaped housing 16 having a pair of compartments 18 and 20 formed therein, with compartment 18 hereinafter referred to as the drive compartment and compartment 20 referred to as the initiator compartment. More specifically, as shown in FIGS. 1 and 3 of the drawings drive compartment 18 contains a pair of stepper motors 22 and 24 (see FIG. 3) and an initiator barrier disk 26. The initiator compartment 20 preferably contains a pair of transfer tubes 28 and 30, although the safe and arm device 10 of the present invention may also be operable with one or more of such transfer tubes 28, 30. Located within each of the transfer tubes 28 and 30 is a conventional initiator 32 and 34, respectively. The initiators 32 and 34 may take the form of B/K Cl $0_4$, Zr/K CL $0_4$, B/K $NO_3$, lead styphnate or lead azide.

Also located within compartment 20 and located adjacent one end of transfer tubes 28 and 30 is an ignitor barrier disk 36. Adjacent the other end of each of the transfer tubes 28 and 30 is located the above-mentioned initiator barrier disk 26. Both of the barrier disks 26 and 36 are operably connected to each other so as to rotate simultaneously in a manner to be described in specific detail hereinbelow. Transfer tubes 28 and 30 are conventional in design and can be likened to a double barrel shotgun with initiators 32 and 34 acting as shells. With device 10 in the safe position, barrier disks 26 and 36 plug the transfer tubes so as to prevent external damage from occurring if initiators 32 and 34 are prematurely activated. In other words, barrier disks 26 and 36 encase both ends, respectively, of transfer tubes 32 and 34.

Figure 2:
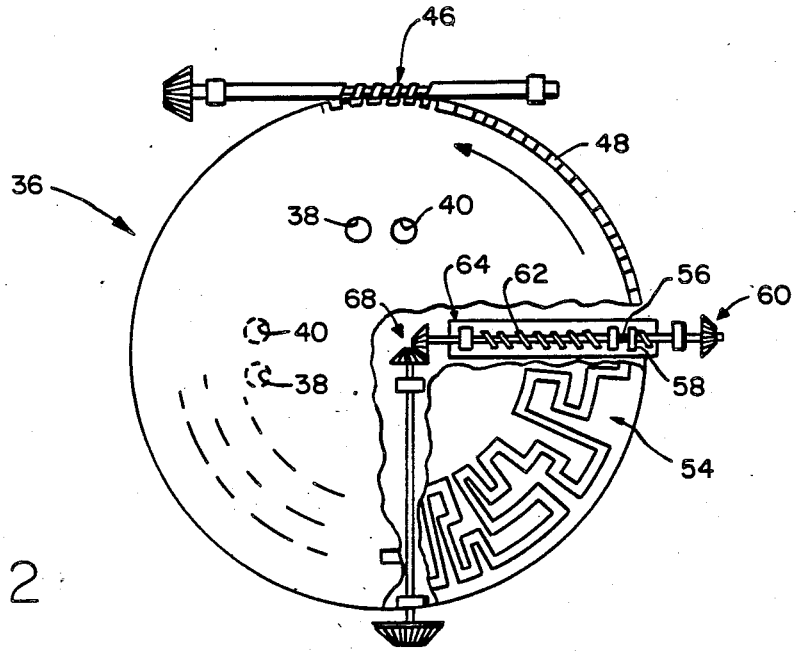
FIG. 2 is a front view, shown partly in segmented fashion, of the ignitor barrier disk of the safe and arm device of the present invention.

Reference is now made to FIG. 2 in order to illustrate the unique configuration of the ignitor barrier disk 36 which enables the device to move from the safe to the armed condition. Both the ignitor barrier disk 36 as illustrated in FIG. 2 of the drawings and the initiator barrier disk 26 have a pair of holes 38 and 40 disposed therein which when the barrier disks 26 and 36 are appropriately positioned (armed position) align with opposite ends, respectively, of transfer tubes 30 and 28. This condition occurs when barrier disks 26 and 36 are rotated in the direction of the arrow shown in FIG. 2 of the drawings. When holes 38 and 40 are disposed in a vertical position as illustrated in dotted fashion in FIG. 2 the holes align properly with transfer tubes 30 and 28. In other words, when the safe and arm device 10 of the present invention is armed, holes 38 and 40 are aligned with the ends of transfer tubes 30 and 28, respectively, while at all other times (that is, in the safe position) disks 26 and 36 block the ends of transfer tubes 28 and 30.

As clearly illustrated in FIG. 3 of the drawings, initiator barrier disk 26 and ignitor barrier disk 36 are interconnected to each other by a suitable gear arrangement 42 and jack screws 44 and 46. This interconnected permits disks 26 and 36 to rotate simultaneously. A conventional stepper motor 22 is utilized as the drive means in order to simultaneously rotate both of the disks 26 and 36. As clearly shown in FIG. 2 of the drawings jack screw 46 (as well as jack screw 44) engage appropriate teeth 48 configured on the outer circumference of barrier disk 36 (as well as barrier disk 26) to complete the interconnection between disks 26 and 36 and gear arrangement 42. It is therefore clearly evident that upon the introduction of appropriate input signals to stepper motor 22, disks 26 and 36 rotate about respective axes 50 and 52 in a step-like fashion.

In order to prevent the accidental or premature rotation of barrier disks 26 and 36 to the armed position in which holes 38 and 40 align with the transfer tubes 30 and 28, a unique signal input is required. In the present invention, this unique signal takes the form of the combination of a uniquely designed maze-like path or slot 54 configured within the ignitor barrier disk 36 in conjunction with a locking peg 56 and its associated carriage 58 as illustrated in FIGS. 2 and 3 of the drawings. The position of peg 56 with respect to the maze-like slot 54 in ignitor barrier disk 36 is controlled in the radial direction by stepper motor 24 which is operably connected to carriage 58 by any suitable gearing arrangment 60. As shown in FIGS. 2 and 3, carriage 58 rides upon a jack screw 62. Appropriate rotation of jack screw 62 by the stepper motor 24 positions peg 56 in the radial direction with respect to the maze-like configured slot 54 within ignitor barrier disk 36. Maintaining peg 56 within the maze-like slot 54 is a scissor-like jack assembly 64 having a jack screw 66 and support frame 65 attached thereto. Jack screw 62 upon which carriage 58 rides is supported by frame 65. Manipulation of scissor/jack assembly 64 is controlled by means of a jack screw 66 and any suitable gearing arrangement 68 in a manner to be described hereinbelow. Appropriate rotation of jack screw 66 moves peg 56 into and out of slot 54.

Figure 4:
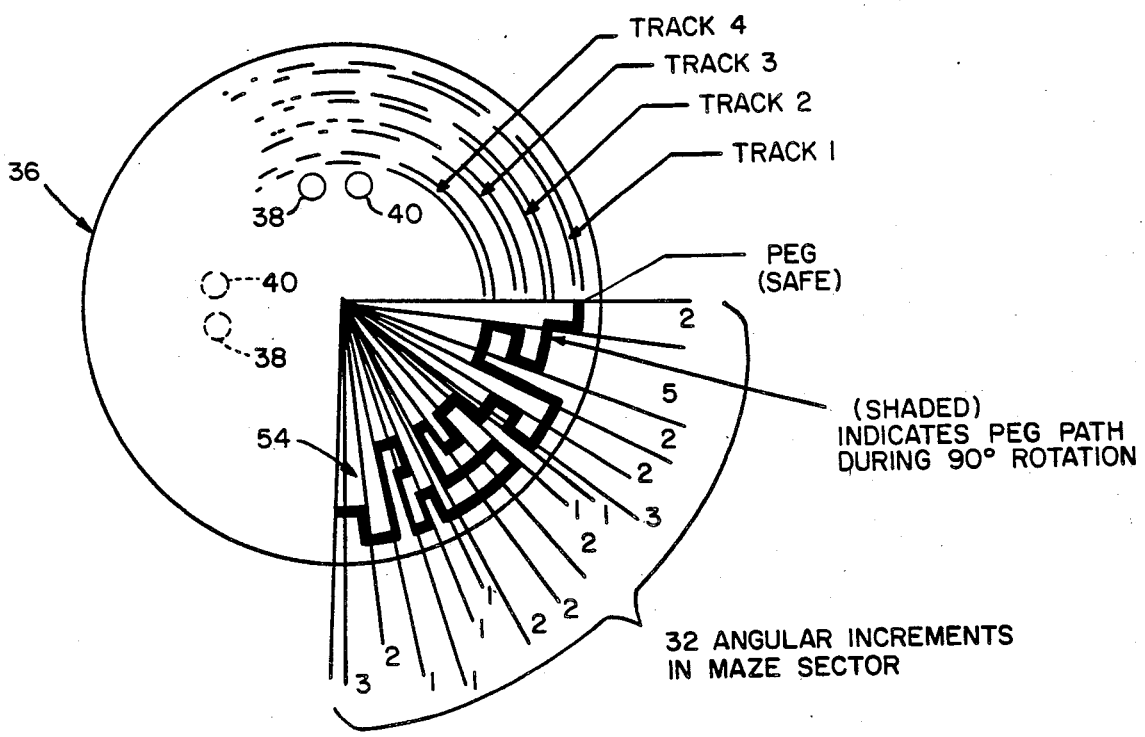
FIG. 4 is a schematic representation of the ignitor barrier disk of the safe and arm device of the present invention illustrating the maze-like slot configured therein.

Moving the safe and arm device 10 of the present invention from its safe to its armed position is accomplished by the step-like rotational movement of ignitor barrier disk 36 and of peg 56 within the maze-like configured slot 54 in a manner illustrated schematically in FIG. 4 of the drawings. More specifically, the maze-like configured slot 54 in the preferred embodiment of this invention is made up of four distinct radially displaced tracks as labeled in FIG. 4 of preselected circumferential length designated in step-like increments as also shown in FIG. 4 of the drawings. For example, in the maze-like slot 54 illustrated there are 32 angular step-like increments. It should be noted, however, that this maze-like configuration may vary in both the radial and circumferential direction.

Consequently, upon the rotation of the ignitor barrier disk 36 in the counterclock wise direction (direction of the arrow in FIG. 2 of the drawings) unless peg 56 is moved in the appropriate radial direction it will jam against the side of one of the indentations of the maze-like configured slot 54. Such jamming would prevent further movement of the ignitor barrier disk 36 as well as the initiator barrier disk 26 connected thereto. Therefore, it is evident that without the appropriate input signals into stepper motors 22 and 24 it is impossible to move the barrier disks 26 and 36 from the safe position to the completely armed position wherein holes 38 and 40 align with the ends of transfer tubes 30 and 28, respectively.

In other words, upon the application of appropriate pulses by any conventional function generator, for example, to stepper motors 22 and 24, it is possible to sequentially rotate the ignitor barrier disk 36 a preselected amount of increments as shown in FIG. 4 of the drawings. After the appropriate incremental movement of barrier disk 36 takes place, peg 56 on carriage 58 is moved by signals to stepper motor 24 in the radial direction along jack screw 62 to either one of the appropriate tracks 1–4. Without the exact knowledge of the configuration of the maze-like slot 54 and the subsequent sending of the appropriate signals to both the ignitor barrier disk 36 as well as the peg 56 and movable carriage 58 it would be impossible to inadvertently or accidentally arm the initiators of the safe and arm device 10 of the present invention.

As an example of the operation of the safe and arm device 10, reference is once again made to FIG. 4. As illustrated therein, initially it takes two pulses to move barrier disk 36 to its first position before it becomes necessary for peg 56 to move from track 1 to track 2. Thereafter, it requires five incremental movements of disk 36 before moving peg 56 from track 2 to track 3. Continuing, it is then necessary to move barrier disk 36 in the reverse (clockwise direction) five increments before moving peg 56 from track 3 to track 4. As seen from FIG. 4 of the drawings the continued incremental movement of barrier disk 36 as well as peg 56 allows for peg 56 to eventually complete its way through the entire maze-like slot 54 until it reaches a position in which the holes 38 and 40 align with the ends of transfer tubes 30 and 28, respectively. Once aligned, actuation of initiators 32 and 34 can take place by means of any electrical actuation device such as a hot bridge wire or an explosive bridge wire, or by means of an optical actuation source such as a laser. A more detailed explanation of the actuating sequence of operation of the present invention is set forth in detail hereinbelow with respect to FIGS. 8–11 of the drawings.

Figure 5:
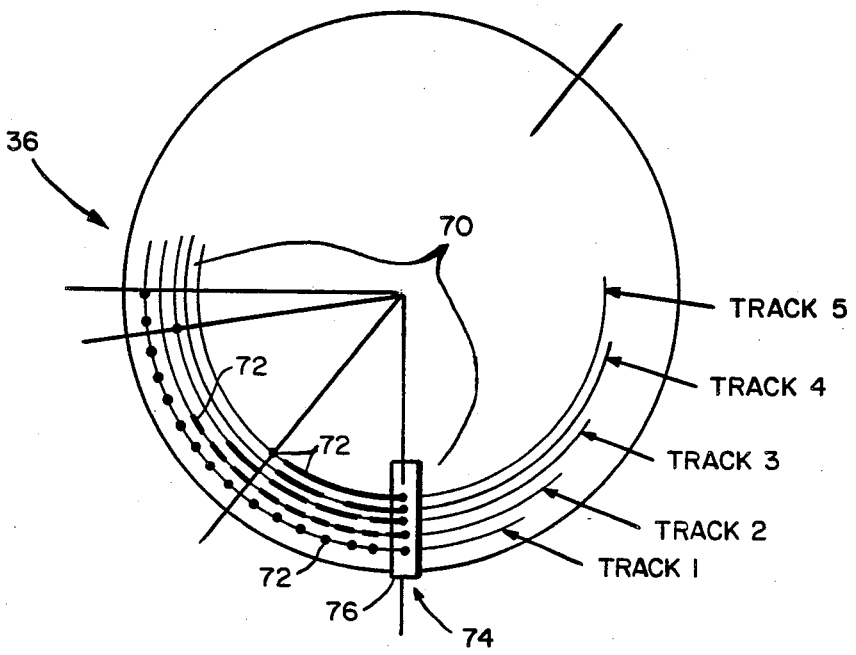
FIG. 5 is a schematic front view of the ignitor barrier disk of the safe and arm device of the present invention illustrating the coding system for monitoring the displacement of the disk.

Another important aspect of the present invention is the ability of the safe and arm device 10 to be constantly monitored, that is, have its status determined between the safe and the armed position. In order to better understand this monitoring feature of the present invention reference is now made to FIGS. 5 and 6 of the drawings. In FIG. 5, the ignitor barrier disk 36 is shown schematically containing a plurality (preferably 5 in number) of tracks which can be monitored at a remote distance by an operator. The number of tracks in disk 36 may be equal to the number of tracks representative of the radial positions of the maze-like slot 54 configured within disk 36 as illustrated in FIG. 4 of the drawings or may be of a greater number (such as the five shown) to increase the sensitivity of the monitoring feature.

Monitoring of the position of the ignitor barrier disk 36 as well as the initiator barrier disk 26 which is connected thereto is accomplished by means of a binary coded hole pattern 70 made up of a plurality of spaced apart holes 72 of preselected length situated within the different tracks within disk 36.

Figure 6:
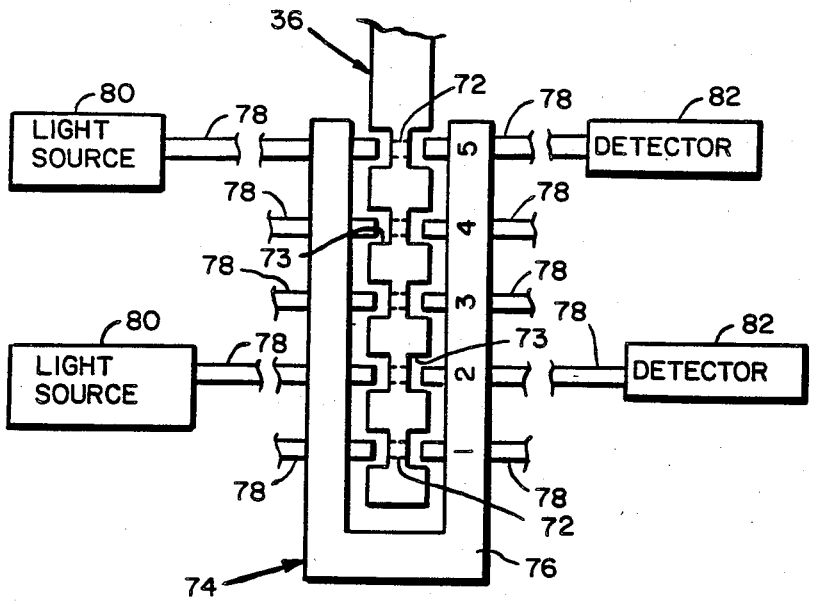
FIG. 6 is an end view illustrating a portion of the monitoring system of the ignitor barrier disk of the safe and arm device of the present invention.

Positioned about disk 36 is a light monitoring assembly 74 illustrated more clearly in FIG. 6 of the drawings. This monitoring assembly 74 is made up of a U-shaped bracket 76 containing a plurality of pairs of optical fibers 78 protruding therethrough from opposite sides of bracket 76. The number of fibers 78 is equal to the number of tracks within disk 36 which as shown in the embodiment of FIGS. 5 and 6 of the drawings are five in number. Also as illustrated in FIG. 6 of the drawings each of the holes 72 of preselected length are formed in respective indentations 73 located within the exterior periphery of the ignitor barrier disk 36.

Consequently, as the ignitor barrier disk 36 and therefore the initiator barrier disk 26 rotate, holes 72 of the coded hole pattern 70 at preselected times allow for light to pass therethrough. In the present invention light is emitted from any suitable light source 80 such as a conventional light emitting diode (LED) and pass through optical fibers 78 by way of holes 72. At other preselected times, because the solid surface of the ignitor barrier disk 36 intercepts the space between juxtaposed optical fibers 78, light cannot pass through fibers 78 from a source 80. Any suitable light detector 82 such as a conventional photodetector receives the light and emits a signal representative thereof. Based upon the sequence of signals from detectors 80 it is possible to ascertain the position of ignitor disk 36.

As a result of the monitoring feature associated with the safe and arm device 10 of the present invention, it is possible for an operator situated at a remote location from the safe and arm device 10 to ascertain the specific position of both the ignitor barrier disk 36 and initiator barrier disk 26 at any time during the safe to arm sequence of operation thereof. As stated above, this determination can be made by analyzing the signals from detectors 80 representative of the binary coded hole pattern 70.

Figure 7:
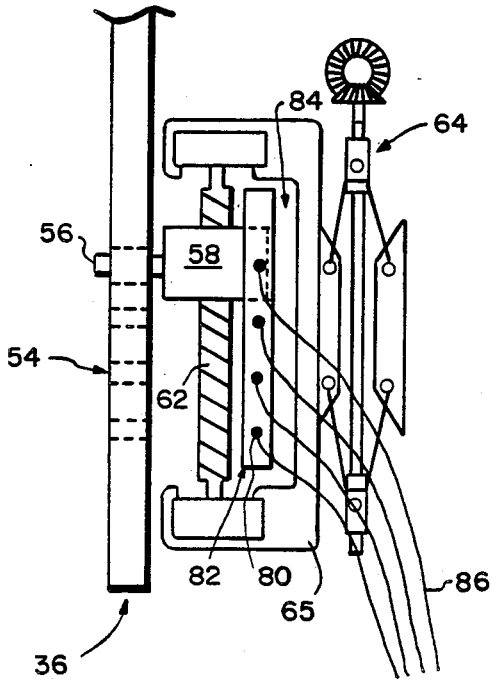
FIG. 7 is a side elevational view, shown partly in segmented fashion, of the scissor arrangement utilized to move the peg associated with the ignitor barrier disk into and out of position as well as the monitoring system for peg travel of the safe and arm device of the present invention.

In addition, it is also possible to monitor the exact position of peg 56 utilized in conjunction with the maze-like configured slot 54. As clearly shown in FIG. 7 of the drawings, the exact position of peg 56 with respect to the maze-like slot 54 is determined by analyzing light output through a plurality of spaced apart openings 80 formed within bar 82 which makes up part of the peg monitoring assembly 84. As the carriage 58 moves through various positions with respect to the maze-like configured slot 54, various openings 80 in bar 82 are either covered or uncovered. The condition of these openings are detected by light passing through optical fibers 86 to a light detector (not shown) in a manner similar to that set forth with respect to the disk position monitoring feature illustrated in FIG. 6 of the drawings. It is clearly evident by the above-mentioned monitoring systems, that the present invention incorporates therein means capable of ascertaining the exact position of disks 26 and 36 as well as the position of peg 56 with respect to the maze-like configured slot 54 in the ignitor disk 36. Therefore, at any time during the arming sequence of the safe and arm device 10, it is possible to determine exactly where in the arming sequence the arm and safe device 10 of the present invention is situated.

The present invention also has the capability of removing peg 56 from its position within maze-like slot 54, enabling the manual rotation of disks 26 and 36, and repositioning peg 56 in the radial direction. In order to clearly understand this aspect of the invention, reference is made to FIG. 3 of the drawings. As shown in FIG. 3 there are three locations in housing 16 designated as A, B and C which enable access to rods 90, 92 and 94, respectively. Rods 92 and 94 can be rotated in only one direction, that is, the safe direction, in order to rotate disks 26 and 36 back to their original safe position and to move carriage 58 and peg 56 in the radial direction back to its original safe position. Rod 90 can be rotated in both directions so as to remove peg 56 from the maze-like slot 54 or, if desired, at a later time reinsert peg 56 therein.

This series of operations is accomplished by inserting any suitable tool through openings A, B and C in order to rotate the respective rods 90, 92 and 94 which are connected to the above mentioned components. For example, rod 90 is interconnected through gearing 68 to scissor assembly 64 in order to lower the scissor assembly 64 and remove the peg 56 from slot 54 in disk 36. Rod 92 is interconnected by means of gear assembly 96 to jack screw 44 which in turn is utilized in conjunction with rod 42 to rotate both the ignitor barrier disk 36 and the initiator barrier disk 26. Rod 94 is interconnected through the stepper motor 24 to gear assembly 60 so as to move carriage 58 radially by means of jack screw 62 to its original safe position.

Therefore, when it is desirable at any time during the arming procedure to inactivate device 10 and remove peg 56 from maze-like configured slot 54, one must merely perform the following operation:

(1) Rotate rod 90 so as to compress scissors assembly 64 and thereby remove peg 56 by way of support 65 out of slot 54.

(2) Rotate rod 92 so that disks 26 and 36 are returned to their original safe position.

(3) Rotate rod 94 so as to move peg 56 and its associated carriage 58 in the radial direction back to its original safe position.

The manual operation of the safe and arm device 10 of the present invention can also be used in conjunction with the coded pattern 70 on ignitor barrier disk 36 so as to reinsert peg 56 to an appropriate location in the maze-like slot 54. This exact position of disk 36 is easily determined by the monitoring system 74 illustrated in FIGS. 5 and 6 of the drawings. With such a capability the present invention allows for manual overriding of the arming sequence and subsequent return of the device back to either the safe position or to another preselected position.

Once the safe and arm device 10 of the present invention is completely in its armed position, that is, a position in which holes 38 and 40 align with respective transfer tubes 30 and 28, it is possible to actuate the initiators 32 and 34 located therein by either conventional electrical or optical actuation device. For a better understanding of this operation, reference is now made to the remaining FIGS. 8–11 of the drawings.

Figure 8:
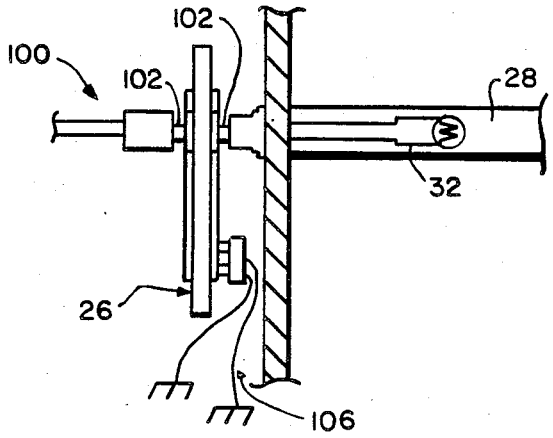
FIG. 8 is a side elevational view, shown partly in segmented fashion, of the initiator barrier disk in conjunction with the ignitor and a grounding means for the safe and arm device of the present invention.
Figure 9:
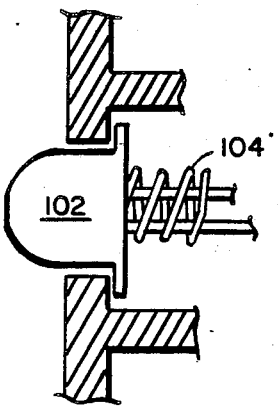
FIG. 9 is a side elevational view, shown partly in segmented fashion, of the contacts utilized with the ignitor and/or the grounding system of the safe and arm device of the present invention.

More specifically, as illustrated in FIG. 8 of the drawings, once transfer tubes 30 and 28 are aligned with holes 40 and 38 located in initiator disk 26 contact can be made between the initiators 32 and 34 and an electrical actuation system 100. This contact is accomplished by means of spring bias contact elements 102 associated both with the actuation system 100 and the initiator 32 (34). A typical contact element 102 is illustrated in FIG. 9 of the drawings. Such a contact element 102 is normally biased by means of a spring 104, for example, to the outward position In the normal safe position of safe and arm device 10 of the present invention, contact 102 rubs against the exterior surface of initiator barrier disk 26 and is therefore out of contact with a similar type contact element 102 on actuation system 100. However, when hole 40 (38) located within the initiator barrier disk 26 is juxtaposed transfer tube 28 (30) then contacts 102 protrudes therethrough and become in direct communication with each other.

Figure 10:
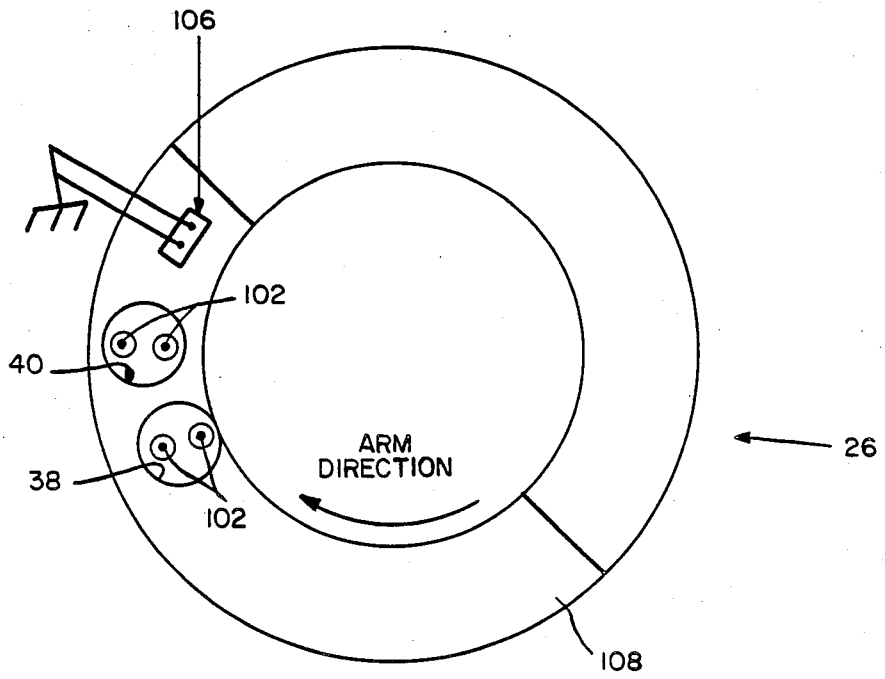
FIG. 10 is an end view of a portion of the initiator barrier disk of the safe and arm device of the present invention.

In addition to the actuation system 100 there is also a grounding unit 106 of the type illustrated in FIGS. 8 and 10 of the drawings. The grounding unit 106 also uses suitable spring biased contacts of the type illustrated in FIG. 9 to rub against a conductive surface 108 formed on initiator barrier disk 26 as illustrated in FIG. 10 of the drawings. In the embodiment disclosed in FIG. 10 the drawings, the arm direction is depicted as being viewed from the initiator compartment 20. It should be realized that the actual direction of rotation of the disks 26 and 36 is not critical as long as holes 38 and 40 can be moved from a position in which they are out of alignment with the ends of transfer tubes 30 and 28 (the safe position) to a position in which they are aligned with rhe ends of transfer tubes 30 and 28 (the armed position).

Figure 11:
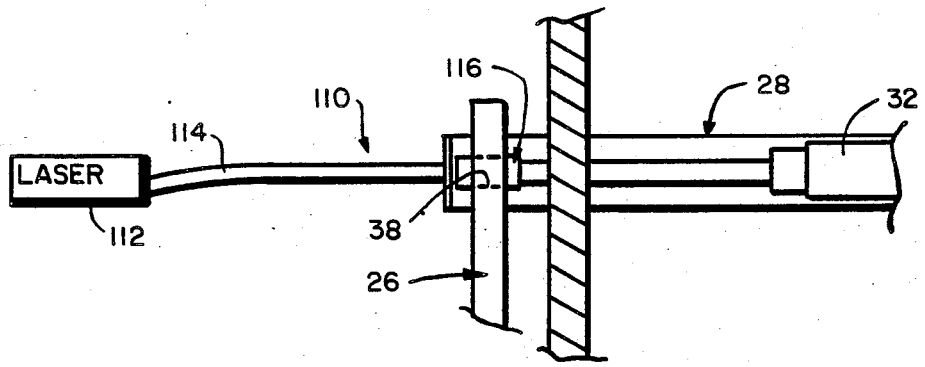
FIG. 11 is a side elevational view, shown partly in segmented fashion, of the initiator barrier disk and initiator in conjunction with an optical initiation system and shown partly in cross section.

Although an electrical actuating system 100 such as a hot wire or bridge wire may be preferred with the present invention, an optical actuation system 110 of the type illustrated in FIG. 11 can also be utilized with safe and arm device 10. In such a system, a laser 112 is utilized in conjunction with an optical fiber 114 to transmit a beam of light through openings 38 or 40 located within the initiator barrier disk 26. When using a light beam with this invention as an actuating device, any suitable lens 116 is inserted within the appropriate openings 38 and 40 of initiator disc 26 in order to focus the light beam emanating from laser 112 onto the initiator 32 located within the transfer tube 28 as illustrated in FIG. 11.

In the same manner that holes 38 an 40 of initiator barrier disk 26 are aligned with one end of transfer tubes 30 and 28 in the armed position of safe and arm device 10 of the present invention, holes 38 and 40 of ignitor barrier disk 36 also align with the other end of the transfer tubes 30 and 28 in the armed position to allow gases resulting from the actuation of initiator 32 (34) to pass therethrough and detonate any suitable ignitor 14 located within ordnance 12 or other such device in which the safe and arm device 10 of the present invention is incorporated.

As clearly evident from the above description of the present invention, safe and arm device 10 of this present invention relies upon a specific, unique signal in the form of a maze-like configured slot 54 together with other novel components in order to substantially eliminate any risk of inadvertent or accidental arming and subsequent detonation of an ordnance. Due to the specifically configured makeup of the safe and arm device 10 of the present invention it is also substantially free from adverse effects of surrounding environmental conditions. The safe and arm device 10 of the present invention can only be armed by the input of preselected signals and has therefore virtually eliminated the chance of inadvertent arming.

Although this invention has been described with reference to a particular embodiment, it will be understood that this invention is also capable of further and other embodiments within the spirit and scope of the appended claims.

I claim:

1. A unique signal, safe and arm device, comprising:

a housing;

at least one initiator;

means situated within said housing for containing said initiator, said initiator containing means having a first open end and a second open end;

means positioned adjacent said first open end of said initiator containing means for activating said initiator;

an initiator barrier means interposed between said activating means and said first open end of said initiator containing means for preselectively moving between a first position preventing said activating means from activating said initiator and a second position permitting said activating means to activate said initiator;

means operably interconnected to said initiator barrier means for permitting preselected movement thereof to take place between said first and said second positions, said preselected movement permitting means including a surface having a uniquely designed pattern of preselected configuration therein, means for operably engaging said pattern along the entire configuration thereof and means for positioning said engaging means with respect to said pattern upon the receipt of appropriate preselected signals; and means operably connected to said initiator barrier means for preselectively moving said initiator barrier means between said first and said second positions upon the receipt of appropriate preselected signals;

whereby operable engagement of said engaging means along said entire pattern configuration during movement of said initiator barrier means enables said initiator barrier means to move from said first position to said second position in order to effect activation of said initiator by said activating means.

2. A unique signal, safe and arm device as defined in claim 1 further comprising means for monitoring said preselected movement of said initiator barrier means between said first and said second positions and providing signals representative thereof.

3. A unique signal, safe and arm device as defined in claim 1 further comprising means for monitoring the position of said engaging means during engagement thereof with said pattern of preselected configuration.

4. A unique signal, safe and arm device as defined in claim 1 further comprising means for repositioning said initiator barrier means to said first position at any time during movement thereof between said first and said second positions.

5. A unique signal, safe and arm device as defined in claim 1 further comprising means for moving said engaging means into and out of engagement with said pattern of preselected configuration.

6. A unique signal, safe and arm device as defined in claim 1 wherein said pattern of preselected configuration is in the form of a slot in said surface and said engaging means comprises a peg designed to fit within said slot.

7. A unique signal, safe and arm device as defined in claim 6 wherein said slot of preselected configuration is of a maze-like configuration.

8. A unique signal, safe and arm device as defined in claim 1 wherein said activating means comprises an electrical activation system.

9. A unique signal, safe and arm device as defined in claim 1 wherein said activating means comprises an optical activation system.

10. A unique signal, safe and arm device as defined in claim 1 wherein said initiator barrier means comprises a rotatable disk having at least one hole therein, said hole aligning with said first end of said initiator containing means when said initiator barrier means is in said second position.

11. A unique signal, safe and arm device as defined in claim 1 wherein said preselected movement permitting means comprises: an ignitor barrier means positioned adjacent said second open end of said initiator containing means and an ignitor for preselectively moving between a first position blocking said second open end and a second position unblocking said second open end.

12. A unique signal, safe and arm device as defined in claim 11 further comprising means for operably connecting said initiator barrier means to said ignitor barrier means for synchronous movement therewith.

13. A unique signal, safe and arm device as defined in claim 12 wherein said uniquely designed pattern of preselected configuration is located on said ignitor barrier means.

14. A unique signal, safe and arm device as defined in claim 13 further comprising means for monitoring the movement of said initiator barrier means and said ignitor barrier means between said first and said second positions and providing signals representative thereof.

15. A unique signal, safe and arm device as defined in claim 14 further comprising means for monitoring the position of said engaging means during engagement thereof with said pattern of preselected configuration.

16. A unique signal, safe and arm device as defined in claim 15 further comprising means for repositioning said initiator barrier means and said ignitor barrier means to said first position at any time during movement thereof between said first and said second positions.

17. A unique signal, safe and arm device as defined in claim 16 further comprising means for moving said engaging means into and out of engagement with said pattern of preselected configuration.

18. A unique signal, safe and arm device as defined in claim 17 wherein said ignitor barrier means comprises a rotatable disk having at least one hole therein, said hole aligning with said second end of said initiator containing means when said initiator barrier means and said ignitor barrier means are in said second position.

19. A unique signal, safe and arm device as defined in claim 14 wherein said movement monitoring means comprises a plurality of coded holes located on said ignitor barrier means and means operably connected thereto for optically sensing the respective position of said holes as said ignitor disk moves from said first position to said second position.

20. A unique signal, safe and arm device as defined in claim 15 wherein said position monitoring means comprises a plurality of holes associated with said engaging means and means operably connected thereto for optically sensing the respective position of said holes.

21. A unique signal, safe and arm device as defined in claim 20 wherein said ignitor barrier means comprises a rotatable disk having at least one hole therein, said hole aligning with said second end of said initiator containing means when said ignitor barrier means is in said second position.

22. A unique signal, safe and arm device as defined in claim 21 wherein said means for moving said initiator barrier disk and said ignitor barrier disk comprises a stepper motor.

23. A unique signal, safe and arm device as defined in claim 22 wherein said means for positioning said engaging means comprises a stepper motor.

24. A unique signal, safe and arm device as defined in claim 23 wherein said housing comprises a first and a second compartment and wherein said initiator barrier disk and said stepper motors are located in said first compartment and said initiator containing means and said ignitor barrier disk are contained in said second compartment.

* * * * *